US006615950B2

(12) United States Patent
Porte et al.

(10) Patent No.: US 6,615,950 B2
(45) Date of Patent: Sep. 9, 2003

(54) SANDWICH ACOUSTIC PANEL

(75) Inventors: Alain Porte, Colomiers (FR); Jacques Lalane, St. Orens (FR)

(73) Assignee: Airbus France, Toulouse Cedex (FR)

( * ) Notice: Subject to any disclaimer, the term of this patent is extended or adjusted under 35 U.S.C. 154(b) by 0 days.

(21) Appl. No.: 09/987,677

(22) Filed: Nov. 15, 2001

(65) Prior Publication Data

US 2002/0070077 A1 Jun. 13, 2002

(30) Foreign Application Priority Data

Dec. 8, 2000 (FR) ..... 00 15981

(51) Int. Cl.[7] ..... E04B 1/82
(52) U.S. Cl. ..... 181/292; 290/291
(58) Field of Search ..... 181/292, 293, 181/294, 295, 291, 290, 288, 284, 285, 286

(56) References Cited

U.S. PATENT DOCUMENTS 4,105,089 A * 8/1978 Judd ..... 181/264
4,399,526 A * 8/1983 Eynck ..... 367/149
6,536,556 B2 * 3/2003 Porte et al. ..... 181/292

FOREIGN PATENT DOCUMENTS

| | | |
|---|---|---|
| EP | 0352993 | 1/1990 |
| GB | 2059341 | 4/1981 |
| JP | 8 87279 | 4/1996 |
| JP | 9 228506 | 9/1997 |

* cited by examiner

*Primary Examiner*—Kimberly Lockett
(74) *Attorney, Agent, or Firm*—Thelen Reid & Priest, LLP; Robert E. Krebs

(57) ABSTRACT

An acoustic panel with several degrees of freedom comprises a resistive layer (14), a compartmentalized structure (16) formed from at least two superposed compartmentalized layers (18) and a back reflector (17), starting from an outside face facing an incident acoustic wave. A porous separator (24) is placed between each pair of adjacent compartmentalized layers. On each of its faces, this separator is fitted with tubular guides (26) that penetrate into at least some of the cells (20) of the compartmentalized layers. This thus aligns the cells over the entire thickness of the compartmentalized structure (24), regardless of the shape of the panel.

10 Claims, 2 Drawing Sheets

SANDWICH ACOUSTIC PANEL

This application claims priority under 35 U.S.C. §§119 and/or 365 to 00 15981 filed in France on Dec. 8, 2000; the entire content of which is hereby incorporated by reference.

TECHNICAL DOMAIN

The invention relates to a sandwich acoustic panel, in other words a noise reducing sandwich panel designed to attenuate an incident sound wave facing an outside face of the panel.

In particular, an acoustic panel according to the invention may be used in the walls of pods or turbojet casings, or in ducts to be soundproofed, etc.

STATE OF THE ART

Existing acoustic panels usually comprise one or several quarter wave resonators superposed on a total reflector. Each resonator itself is composed of a resistive layer that is more or less permeable to air, and a compartmentalized structure, usually of the honeycomb type. The resistive layer covers the face of the compartmentalized structure facing outside, in other words towards the incident sound wave. On the other hand, the total reflector covers the face of the resonator opposite this incident wave. By convention, the "front face" is the side of the panel on which the resistive layer is placed, and the "back face" is the opposite side of the panel covered by the reflector.

In this conventional arrangement of acoustic panels, the resistive layer performs a dissipation role. When a sound wave passes through it, viscous effects occur that transform the acoustic energy into heat.

The thickness of the compartmentalized structure can be varied to match the panel to the characteristic frequency of the noise to be attenuated. The noise dissipation in this resistive layer is maximum when the height of the cells in the compartmentalized core is equal to a quarter of the wavelength of the frequency of the noise to be attenuated. Cells in the compartmentalized structure then behave like wave guides perpendicular to the surface of the panel, such that they have a "localized reaction" type response. The cells form an assembly of quarter wave resonators in parallel.

The back reflector creates total reflection conditions essential for the behaviour of the compartmentalized core described above.

In general, an acoustic panel must satisfy acoustic requirements.

The first of these requirements applies to the acoustic homogeneity of the panel. In other words, the acoustic processing is particularly effective if it is conform with its specification over its entire area. Failure to respect this requirement depends on the nature of the elements making up the panel, their relative layout and adhesives used for their assembly.

Another acoustic requirement is the "localized reaction" requirement. If this requirement is not satisfied, then there is a transverse propagation of sound waves called "lateral energy leak" inside the panel, which opposes "quarter wave" type operation of the compartmentalized structure.

When the panel is fitted on an aircraft engine, these acoustic requirements are combined with other requirements for resistance to the environment, structural requirements and aerodynamic requirements.

Thus, an acoustic panel integrated in an aircraft engine must be able to resist severe usage conditions. In particular, the panel must not become delaminated, even in the presence of high negative pressures, it must be capable of resisting corrosion and erosion, for example due to sand, and it must have a good electrical conductivity particularly in order to resist lightning strikes and it must contribute to the mechanical absorption of shocks following the loss of a blade.

An acoustic panel integrated in an aircraft engine must also have sufficient structural strength to resist the weight of a man and to transfer aerodynamic and inertial forces from the air intake to the engine casing.

Finally, the surface condition of an acoustic panel integrated in an aircraft engine must be consistent with the aerodynamic lines and continuity requirements of surfaces in contact with air flows.

Known acoustic panels may be classified in three categories; panels with a non-linear single degree of freedom (non-linear SDOF), panels with a linear single degree of freedom (linear SDOF), and panels with two degrees of freedom (double degree of freedom (DDOF)).

In panels with a non-linear single degree of freedom, the resistive layer is composed of a perforated metallic or composite layer.

The advantage of a panel of this type is that it enables good control over the percent of open surface area, it has good structural strength and is easy to make.

On the other hand, it has the disadvantage that it is acoustically very non-linear and that the strength is very dependent on the tangential flow velocity at the surface. Furthermore, since the frequency damped by each cell depends on its depth, and since the depth of all cells in the panel is the same, the frequency range damped by this type of panel is restricted. Furthermore, when the resistive layer is made of a composite material, the structure has low resistance to erosion.

In acoustic panels with a linear single degree of freedom, the resistive layer is a micro-porous layer, for example composed of a metallic fabric, a perforated plate combined with an acoustic fabric or a metallic fabric associated with an acoustic fabric.

The use of this type of panel makes it possible to adjust the acoustic resistance by modifying the components of the micro-porous layer. It is efficient over a reasonable frequency range. This type of panel also has the advantage that its non-linearity is low to moderate, while the acoustic resistance is only slightly dependent on the tangential flow speed at the surface.

However, the production of a sandwich panel with a linear single degree of freedom is more complicated than the construction of a panel with a non-linear single degree of freedom, since the resistive layer comprises two components. If the components or assembly processes are not controlled, the structure may comprise areas of acoustic non-homogeneity, or risks of delamination of the resistive layer. Furthermore, risks of corrosion in the resistive layer impose an additional constraint on the choice of the material used. Furthermore, the process for assembly of this type of panel is long and expensive.

Finally, an acoustic panel with two degrees of freedom comprises two superposed compartmentalized cores, in addition to a perforated resistive layer and a back reflector, separated by an intermediate resistive layer called the "septum" which is usually micro-porous.

Compared with the other types of acoustic panels, panels with two degrees of freedom have a wider damped frequency range, a possibility of adjusting the acoustic resistance by means of two resistive layers, and low to moderate acoustic non-linearity.

However, acoustic panels with two degrees of freedom have the disadvantage that areas of acoustic non-homogeneity occur due to poor alignment of the cells in the two compartmentalized cores, that inevitably occurs when the panel is being formed. There are also parasite transverse propagation phenomena in areas in which the cells of the two compartmentalized cores are not aligned. Finally, the process for assembly of a panel of this type is long and expensive, since the various elements of the structure have to assembled one by one.

PRESENTATION OF THE INVENTION

The purpose of the invention is an acoustic panel with an innovative design that would enable it to take advantage of panels with several degrees of freedom, while eliminating the disadvantages due to alignment defects in the cells of compartmentalized structures, such as the risks of acoustic non-homogeneity and transverse propagation of acoustic waves.

According to the invention, this result is achieved by means of a sandwich acoustic panel comprising a resistive layer forming a front face of the panel, a compartmentalized structure formed from at least two superposed compartmentalized layers each comprising a network of cells, a porous separator inserted between the adjacent compartmentalized layers and a reflector forming the back face of the panel, characterized in that the porous separator is provided with guides on each face penetrating into at least some of the cells of the compartmentalized layers adjacent to the separator, distributed over the entire surface of the separator.

The presence of guides on each face of the porous separator makes it possible for partitions, and consequently cells of the compartmentalized structure, to be made continuous between the inner surface of the resistive layer and the reflector. Therefore local misalignment problems of cells that necessarily occur on panels with several degrees of freedom according to prior art, composed of several superposed compartmentalized structures, are eliminated. Consequently, risks of non-homogeneity no longer exist.

According to one preferred embodiment of the invention, the resistive layer, compartmentalized layers, the porous separator and the reflector are assembled to each other by bonding.

Advantageously, the resistive layer, the compartmentalized layers, the porous separator and the reflector are all made from identical materials or materials compatible with the adhesive used to assemble them.

These materials are preferably chosen from the group comprising metallic, composite and thermoplastic materials.

Depending on the case, guides include either aligned elements, positioned on each side of the porous separator, or elements passing through the porous separator.

In the preferred embodiments of the invention, the guides are tubular or formed of solid rods, of circular cross-section. This cross-section may be substantially uniform over the entire length of the guide or, on the contrary, provided with tapered ends in order to improve their mounting. They may have a different shape, for example a star-shaped section with at least three branches, without going outside the scope of the invention. In addition, the rods may be made from a porous material or not.

BRIEF DESCRIPTION OF THE DRAWINGS

We will now describe a preferred embodiment of the invention as a non-limitative example, with reference to the attached drawings in which.

DETAILED DESCRIPTION OF ONE PREFERRED EMBODIMENT OF THE INVENTION

Figure 1:
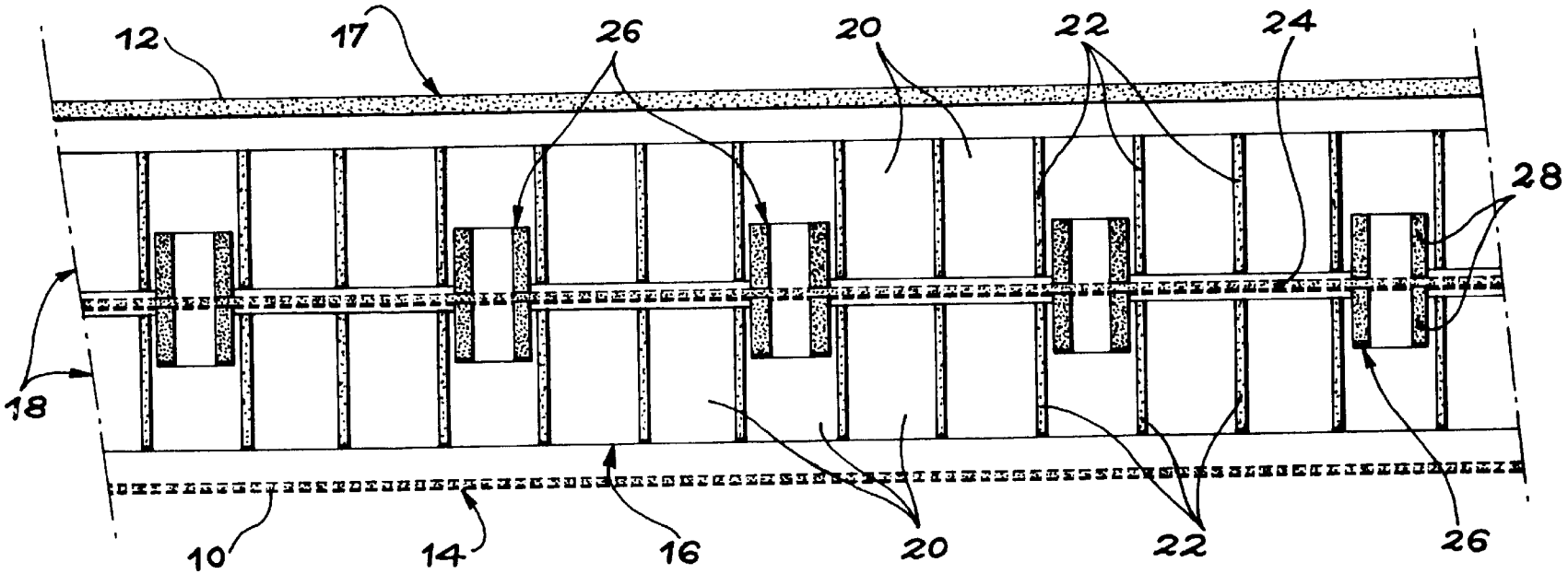
FIG. 1 is a sectional view that diagrammatically shows a sandwich acoustic panel according to the invention.

As shown diagrammatically in FIG. 1, a sandwich acoustic panel conform with the invention is composed of a stack of several constituents fixed to each other. To facilitate understanding, these constituents are shown slightly separated from each other. In practice, they are in close contact over the entire surface of the panel.

The acoustic panel according to the invention may be plane, as shown as an example. However, it may also be in any other shape, and particularly a curved shape as is the case in which it is integrated in the pod or engine casing of a turbojet.

The structure of the panel will now be described starting from the outside face 10 of the panel called the "front face", and working in order towards its inside face 12, called the "back face". In the figure, the front face 10 and the back face 12 are facing the bottom and top respectively.

Thus, starting from the front face 10, the acoustic panel according to the invention comprises a resistive layer 14, a compartmentalized structure 16 and a back reflector 17, in sequence.

The resistive layer 14 is porous or perforated. It is in contact with the outside air and is the first layer contacted by the acoustic wave that is to be damped. As in existing acoustic panels with two degrees of freedom, the resistive layer 14 is designed to transform incident acoustic energy into heat.

When the panel is integrated in the pod of a turbojet, the resistive layer 14 may also receive and transfer aerodynamic and inertial forces to structural pod—engine connections, and also forces necessary for maintenance of the pod.

The compartmentalized structure 16 comprises at least two superposed compartmentalized layers 18. The number of layers 18 forming the compartmentalized structure 16 is equal to the required number of degrees of freedom for the acoustic panel. In the embodiment shown in the single figure, the acoustic panel has two degrees of freedom and therefore the compartmentalized structure 16 comprises two acoustic layers 18. However, this number can be greater than two without going outside the scope of the invention.

Each of the compartmentalized layers 18 of the structure 16 comprises a network of cells 20, the cells of each network being delimited by partitions 22. The networks of cells 20 in the different layers 18 are identical, so that the cells 20 and the partitions 22 may be put in line as shown in FIG. 1. Consequently, the shapes, dimensions and distribution of cells 20 in each of the layers 18 are the same.

In one preferred embodiment of the invention, the compartmentalized layers 18 are in the shape of a honeycomb. The cross section of the cells 20 is then hexagonal. However, compartmentalized layers with cells 20 with different cross sections (circular, triangular, square, trapezoidal, etc.) may be used without going outside the scope of the invention.

The compartmentalized structure 16 comprising the compartmentalized layers 18 performs the same function as in acoustic panels with several degrees of freedom according to prior art. This function is well known to an expert in the subject, and it will not be discussed here.

A separator 24 is inserted between each pair of compartmentalized layers 18 adjacent to the compartmentalized structure 16. In the case of a panel with two degrees of freedom like that illustrated in FIG. 1, a single separator is placed between the compartmentalized layers 18. More generally, the number of separators 24 is one less than the number of compartmentalized layers 16.

Each separator 24 is made from porous material. This material is chosen for its acoustic resistance qualities, for its resistance to corrosion and for its low mass, since the structural stress applied to it is low.

The porous material in the separator 24 may be a metallic or synthetic fabric, or it may be based on miscellaneous fibers. It may also be a thermoplastic or porous plastic material. It performs the same function as porous separators inserted between the compartmentalized layers of acoustic panels with several degrees of freedom according to prior art. This function is well known to a person skilled in the subject, and it will not be described here.

According to the invention, the porous separator 24 comprises guides 26 on each of its faces. These guides 26 are uniformly distributed over the entire surface of the separator 24, according to a network that can be superposed on the network of cells 20 in the compartmentalized layers 18. Furthermore, the shape and size of the guides 26 are such that each can penetrate into one of the cells 20 with the smallest possible clearance.

The "superposable network" expression means that each of the guides 26 is located on the face of a cell 20 when the compartmentalized layers 18 and the separator(s) 24 is (are) superposed. This result can be obtained either by providing one guide 26 on each face of the separator 24 for each cell 20 on the adjacent compartmentalized layer 18, or preferably by providing fewer guides 26 on the separator 24 than cells 20, as shown in FIG. 1. In this case, the number of guides 26 will simply be sufficient to make sure that cells 20 and partitions 22 can be correctly aligned over the entire panel (for example one guide 26 could be provided for three to five aligned cells 20). In order to satisfy this condition, the number of guides 26 needs to be increased when the curvature of the panel is greater.

The shape presented by the guides 26 may be arbitrary, provided that the required mechanical position is obtained. In the embodiment shown in FIG. 1, the guides 26 are tubular. However, they could be in any other shape such as a star shape with three or four branches without going outside the framework of the invention.

Figure 2A:
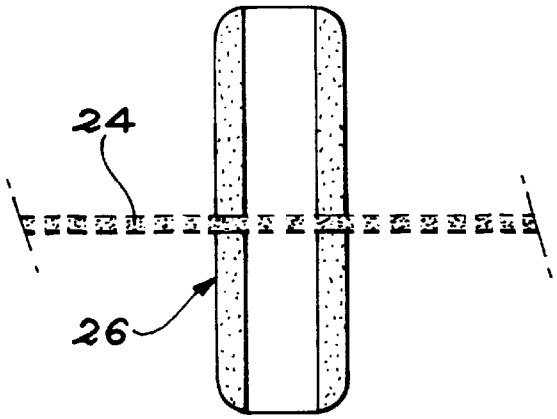
FIGS. 2*a* to 2*c* are sectional views, at a larger scale, that show alternative embodiments of the guides carried by the porous separator.

In particular, when the guides 26 are tubular, the shape of their cross-section may be circular or polygonal. This cross-section may be uniform as shown in FIG. 1, or it may be variable, for example it may be smaller and rounded towards the ends to facilitate assembly, as shown in FIG. 2*a*.

Figure 2B:
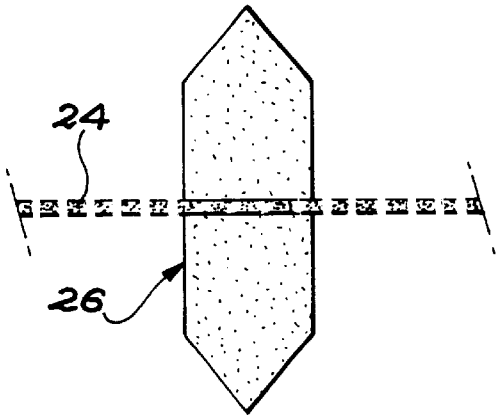
Figure 2C:
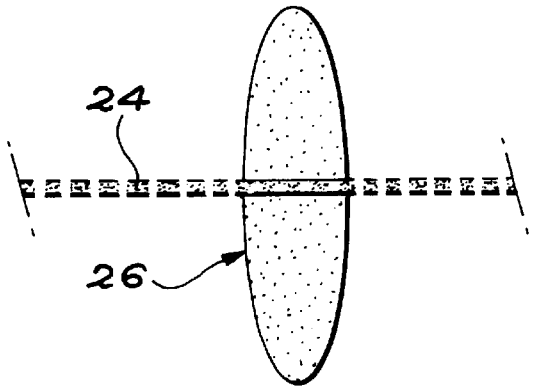

In another alternative embodiment, shown in FIGS. 2*b* and 2*c*, the guides 26 are formed by solid rods. In the embodiment of FIG. 2*b*, the rod is ended by a conical end. In the embodiment of FIG. 2*c*, the rod has a rounded shape such as an oval or an elliptic shape, in section along its longitudinal axis.

The guides 26 may be made from arbitrary materials, depending mainly on the material chosen for the separator on which they are supported. The guides 26 may be fixed to the separator by welding, bonding, insertion, etc., depending on the material.

In the embodiment illustrated in FIG. 1, the guides 26 comprise pairs of aligned tubes 28, added on separately on each side of the separator 24. The tubes 28 are aligned using an appropriate tool at the time that the tubes are fixed to the separator, for example by bonding.

In one alternative embodiment, the guides 26 comprise elements 28 (in the shape of tubes in FIG. 1) that pass through the separator 24. The alignment is then achieved by construction, without it being necessary to use a special tool. However, in the case of tubular guides, they are not provided with a separator, unless the tubular guides that are fitted on the inside of individual separators are used, before or after their attachment to the separator.

The back reflector 17 is made in the same way as for acoustic panels according to prior art, based on methods well known to a person skilled in the art. Therefore, there will be no particular description here.

The various components of the acoustic panel according to the invention, in other words the resistive layer 14, the compartmentalized layers 18, the separator(s) 24 and the back reflector 17, are assembled to each other by bonding. The assembly is made:

1) by placing the resistive layer 14 on a mould;
2) by bonding a first compartmentalized layer 18 on the resistive layer 14, using an adhesive;
3) by bonding the separator 24 fitted with its guides 26 on the first compartmentalized layer 18, taking care that the guides 26 fitted on the face of the separator facing the first compartmentalized layer, actually penetrate into the cells in this layer;
4) by bonding a second compartmentalized layer 18 onto the separator 24, taking care that the guides 26 mounted on the face of the separator facing the separator penetrate into the cells of the second compartmentalized layer; and
5) by bonding the back reflector 17 onto the second compartmentalized layer 18 using an adhesive.

This description relates to the manufacture of a panel with two degrees of freedom as shown on FIG. 1. When the number of degrees of freedom is greater, steps 3) and 4) are performed as many times as necessary.

The adhesive used to bond the various components of the panel together may be in the shape of a film or may be sprayed or atomised on at least one of the components to be assembled.

In general, the various panel components may be made from different metallic, composite or thermoplastic materials, etc.

The use of the separator 24 according to the invention can produce a panel with materials identical to or compatible with the adhesive used, in other words in a single family of materials (for example any composite material). For example, this avoids problems caused by corrosion and galvanic couples. Furthermore, a high quality bonding can be guaranteed between the different components.

Furthermore, and essentially, the use of a separator 24 equipped with guides 26 ensures that cells and compartments of the compartmentalized layers 18 are continuous between the front resistive layer 14 and the back reflector 17. The cells 20 are thus automatically aligned regardless of the shape of the panel, and particularly in the case of a complex or non-developable aerodynamic shape. Furthermore, this layout eliminates lateral energy leaks and consequently is a means of keeping a localized acoustic reaction.

What is claimed is:

1. Sandwich acoustic panel comprising a resistive layer forming a front face of the panel, a compartmentalized structure formed from at least two superposed compartmentalized layers each comprising a network of cells, a porous separator inserted between adjacent compartmentalized layers and a reflector forming a back face of the panel, in which the porous separator is fitted with guides on each of its faces that penetrate into at least some of the cells of the compartmentalized layers adjacent to the separator, distributed over the entire surface of the separator.

2. Sandwich acoustic panel according to claim 1, in which the resistive layer, compartmentalized layers, the porous separator and the reflector are assembled to each other by bonding.

3. Sandwich acoustic panel according to claim 1, in which the resistive layer, the compartmentalized layers, the porous separator and the reflector are all made of identical or compatible materials using an adhesive to assemble them.

4. Sandwich acoustic panel according to claim 3, in which the said materials are chosen from the group comprising metallic, composite and thermoplastic materials.

5. Sandwich acoustic panel according to claim 1, in which the guides comprise aligned elements added on each side of the porous separator.

6. Sandwich acoustic panel according to claim 1, in which the guides comprise elements passing through the porous separator.

7. Sandwich acoustic panel according to claim 1, in which the guides are tubular.

8. Sandwich acoustic panel according to claim 1, in which the guides are solid rods.

9. Sandwich acoustic panel according to claim 1, in which the guides are tapered at their ends.

10. Sandwich acoustic panel according to claim 1, in which the cross-sections of the guides are uniform over their entire length.

* * * * *